US005242074A

United States Patent [19]

Conaway et al.

[11] Patent Number: 5,242,074

[45] Date of Patent: Sep. 7, 1993

[54] CLOTHES HAMPER

[75] Inventors: Brian J. Conaway, Wooster; Tyrone M. Keyes, Cincinnati, both of Ohio

[73] Assignee: Rubbermaid Incorporated, Wooster, Ohio

[21] Appl. No.: 817,548

[22] Filed: Jan. 7, 1992

[51] Int. Cl.[5] ..... B65D 51/18

[52] U.S. Cl. ..... 220/254; 220/338; 220/634; 220/676; 220/771

[58] Field of Search ..... 220/337, 338, 254, 634, 220/643, 648, 649, 691, 676, 94 R, 94 A, 908, 909, 771

[56] References Cited

U.S. PATENT DOCUMENTS

| | | | |
|---|---|---|---|
| 3,682,351 | 8/1972 | DePutter | 220/676 X |
| 3,938,691 | 2/1976 | Dumas | 220/94 A |
| 3,964,609 | 6/1976 | Perrella | 206/540 |
| 4,416,197 | 11/1983 | Kehl | 220/908 X |
| 4,573,603 | 3/1986 | Starling et al. | 220/94 A X |
| 4,694,972 | 9/1987 | Bimonte et al. | 220/401 |
| 4,753,367 | 6/1988 | Miller et al. | 220/404 |
| 5,011,041 | 4/1991 | Kakizaki | 220/507 |
| 5,048,715 | 9/1991 | Wolff | 220/335 |
| 5,080,251 | 1/1992 | Noack | 220/335 |

FOREIGN PATENT DOCUMENTS

| | | | |
|---|---|---|---|
| 4018881 | 1/1991 | Fed. Rep. of Germany | 220/676 |

*Primary Examiner*—Allan N. Shoap
*Assistant Examiner*—Nova Stucker
*Attorney, Agent, or Firm*—Renner, Kenner, Greive, Bobak, Taylor & Weber

[57] ABSTRACT

A hamper (10) includes a base container portion (11), a shroud (12), and a cover (13). The base container portion includes a bottom surface (14) and a front wall (15), a rear wall (18) and opposed side walls (16, 17) extending upwardly from the bottom surface (14) to form an open top defined by a peripheral upper rim (19). The shroud (12) rests on the rim (19) to strengthen the same and is attached to the side walls (16, 17). The cover (13) is pivotally attached to the shroud (12). Vent apertures (27, 29) are provided in recessed arcuate walls (26, 30) positioned beneath the front wall (15) and the rear wall (18).

18 Claims, 5 Drawing Sheets

CLOTHES HAMPER

TECHNICAL FIELD

This invention relates to a hamper for holding clothes and the like. More particularly, this invention relates to a plastic clothes hamper of a three-piece design rendering it stable and free of sharp edges which could prove detrimental to the clothes stored therein.

BACKGROUND ART

Conventional clothes hampers are usually made of a plastic, metallic or cloth/woven material and include a base container and a cover which is either hingedly attached to the container or removably positioned thereon. One problem with such devices is that quite often sharp edges or crevices are exposed, for example, the area at which the cover is pivoted to the container, and clothes are susceptible to being snagged, particularly as they are being put into or removed from the hamper.

Moreover, such hampers are usually not very stable. Many users have a tendency to utilize such hampers as a table to temporarily store items, and most hampers are not designed for such use and could warp or fail when exposed to such forces. In addition, such abuse often causes the four side walls of the base container to be temporarily flexed to a parallelogram shape which, at a minimum, could cause a hinged lid to be displaced from the container or fit poorly.

Another potentially irritating aspect of prior clothes hampers is the visual presence of vent holes. It is desirable for hampers to have such holes to prevent the build-up of offensive odors as, for example, may be emitted by dirty, wet clothing. Some manufacturers attempt to blend such holes in with the external aesthetics of the hamper, while others merely obtrusively position the holes, for example, on the sides of the hamper without regard to the resulting offensive appearance.

The present invention addresses these problems and deficiencies in the prior art by providing a sturdy, snagproof, all plastic hamper in which the vent holes are present but undetectable by the user during normal use.

DISCLOSURE OF THE INVENTION

It is thus a primary object of the present invention to provide a clothes hamper with a hinged cover which is sturdy and of a plastic construction.

It is another object of the present invention to provide a clothes hamper, as above, which presents minimal sharp edges or exposed crevices for the potential snagging of clothes to be stored therein.

It is a further object of the present invention to provide a clothes hamper, as above, in which the cover-to-container hinge connection will not be unintentionally detached.

It is yet another object of the present invention to provide a clothes hamper, as above, in which the vent holes are substantially hidden.

These and other objects of the present invention, as well as the advantages thereof over existing art forms, which will become apparent from the description to follow, are accomplished by the improvements hereinafter described and claimed.

In general, a hamper according to the present invention includes a bottom surface having a front wall, a rear wall, and opposed side walls extending upwardly therefrom to form an open top defined by an upper rim.

A shroud rests on the upper rim to provide rigidity to the same and is attached to the side walls.

In another aspect of the invention a recessed arcuate surface is formed between at least one of the walls and the bottom surface and is provided with vent apertures therethrough that are thereby hidden from normal view.

A preferred exemplary clothes hamper incorporating the concepts of the present invention is shown by way of example in the accompanying drawings without attempting to show the various forms and modifications in which the invention might be embodied, the invention being measured by the appended claims and not by the details of the specification.

PREFERRED EMBODIMENT FOR CARRYING OUT THE INVENTION

Figure 1:
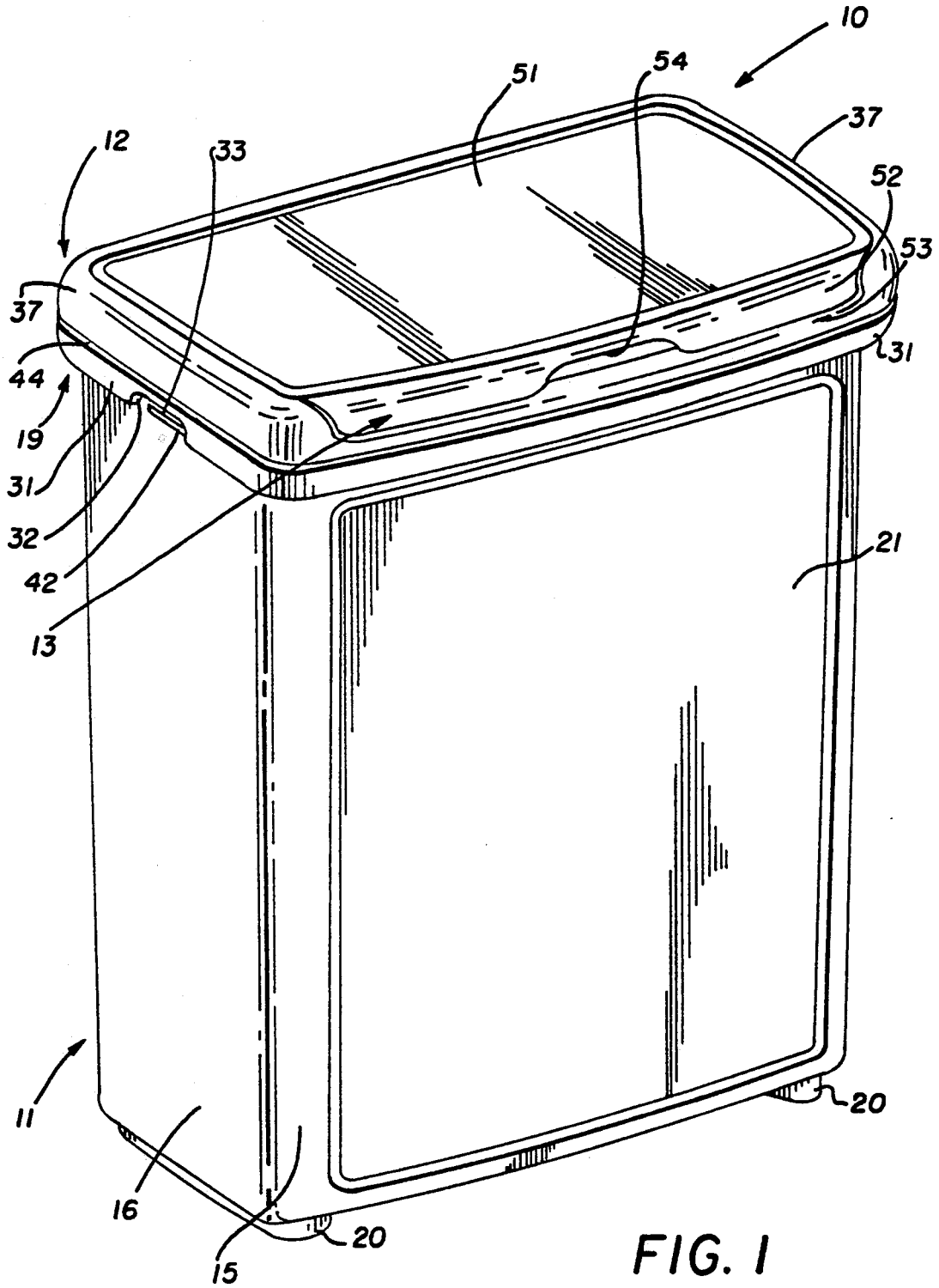
FIG. 1 is a perspective view of a hamper made in accordance with the concepts of the present invention.

A hamper, generally of the type used to hold clothes or other articles, and made in accordance with the concepts of the present invention, is generally indicated by the numeral 10. Hamper 10 includes three primary components, a base container portion generally indicated by the numeral 11, a shroud generally indicated by the numeral 12, and a cover generally indicated by the numeral 13. Base container 11, shroud 12 and cover 13 are all preferably made of a sturdy plastic material such as high density polyethylene.

Figure 6:
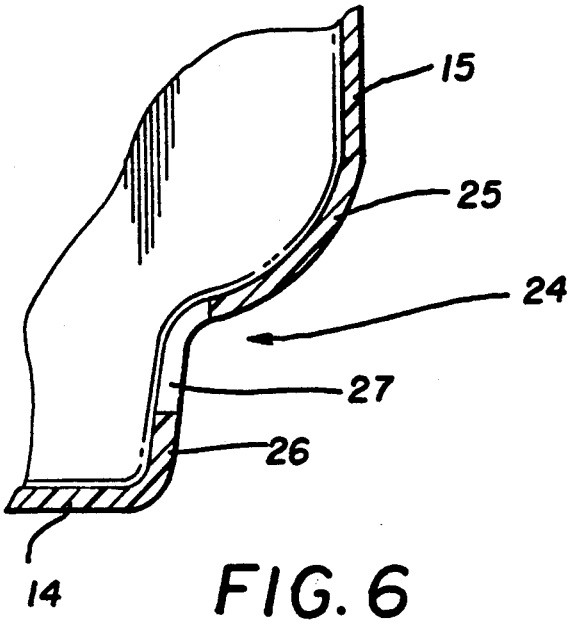
FIG. 6 is an enlarged sectional view taken substantially along line 6—6 of FIG. 2.

Base container 11 includes a bottom surface 14 (FIG. 6) having a front wall 15, side walls 16 and 17, and a rear wall 18 extending upwardly therefrom to form a generally open top defined by an upper shoulder or rim indicated generally by the numeral 19 and extending around the entire upper periphery of base container 11. Foot members 20 which are shown as extending rearwardly along side walls 16 and 17 and as depending from bottom surface 14 may be formed in hamper 10, as desired.

Front wall 15 may be provided with a pedestal 21 to receive a decorative feature, such as a wicker or other pattern (not shown) and likewise side walls 16 and 17 as well as rear wall 18 may be similarly aesthetically adorned, if desired. Rear wall 18 is shown, however, as having a similar pedestal 22 within which are formed a pattern of vent apertures 23. Such apertures are typical in conventional hampers to assure that offensive odors are not allowed to build up within the hamper and while, as described hereinabove, their presence can be found to be aesthetically offensive to the user, positioning the apertures 23 of hamper 10 only on the rear wall 18, which is normally not in the sight of the user, is not aesthetically displeasing.

Figure 2:
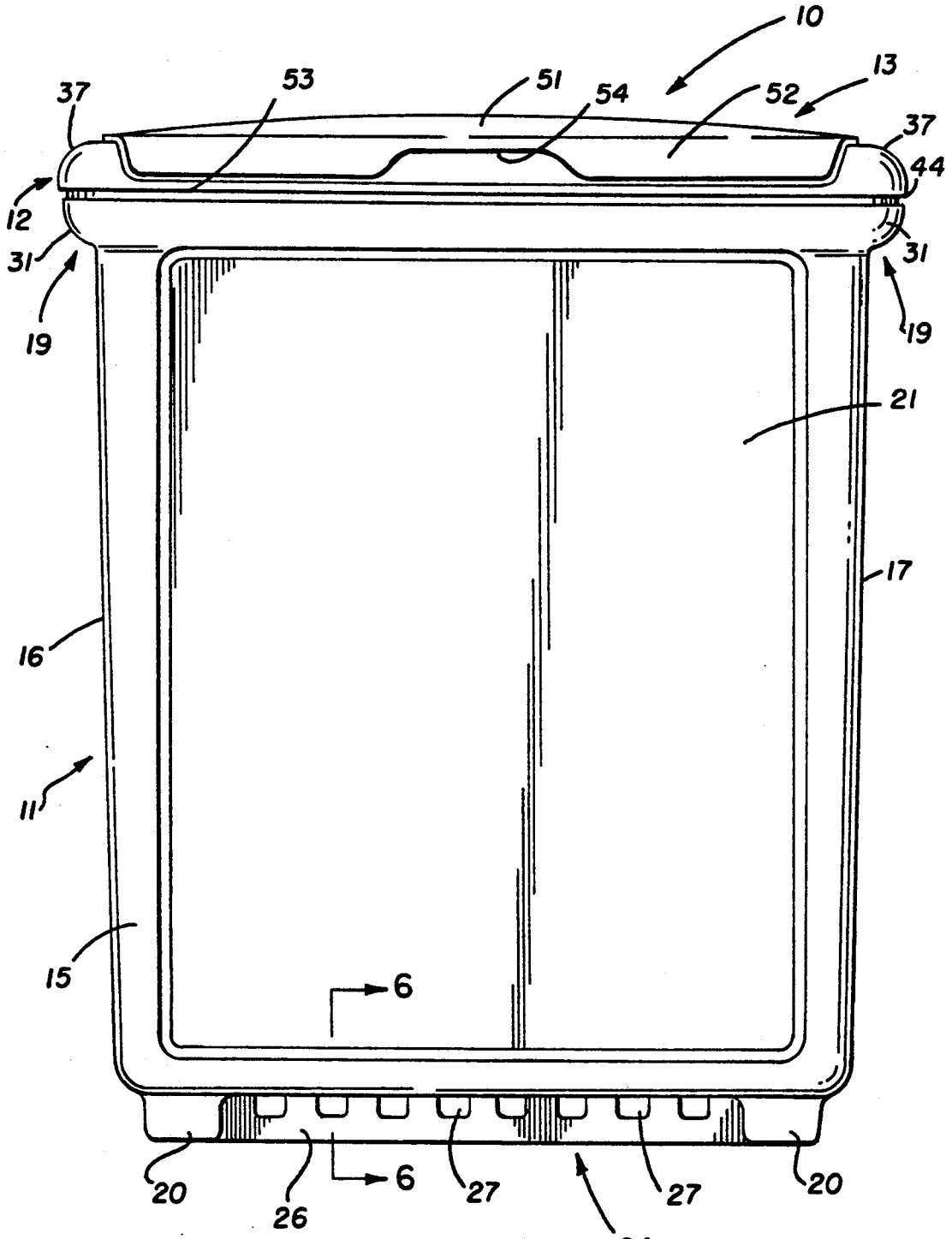
FIG. 2 is a front elevational view of the hamper of FIG. 1.
Figure 3:
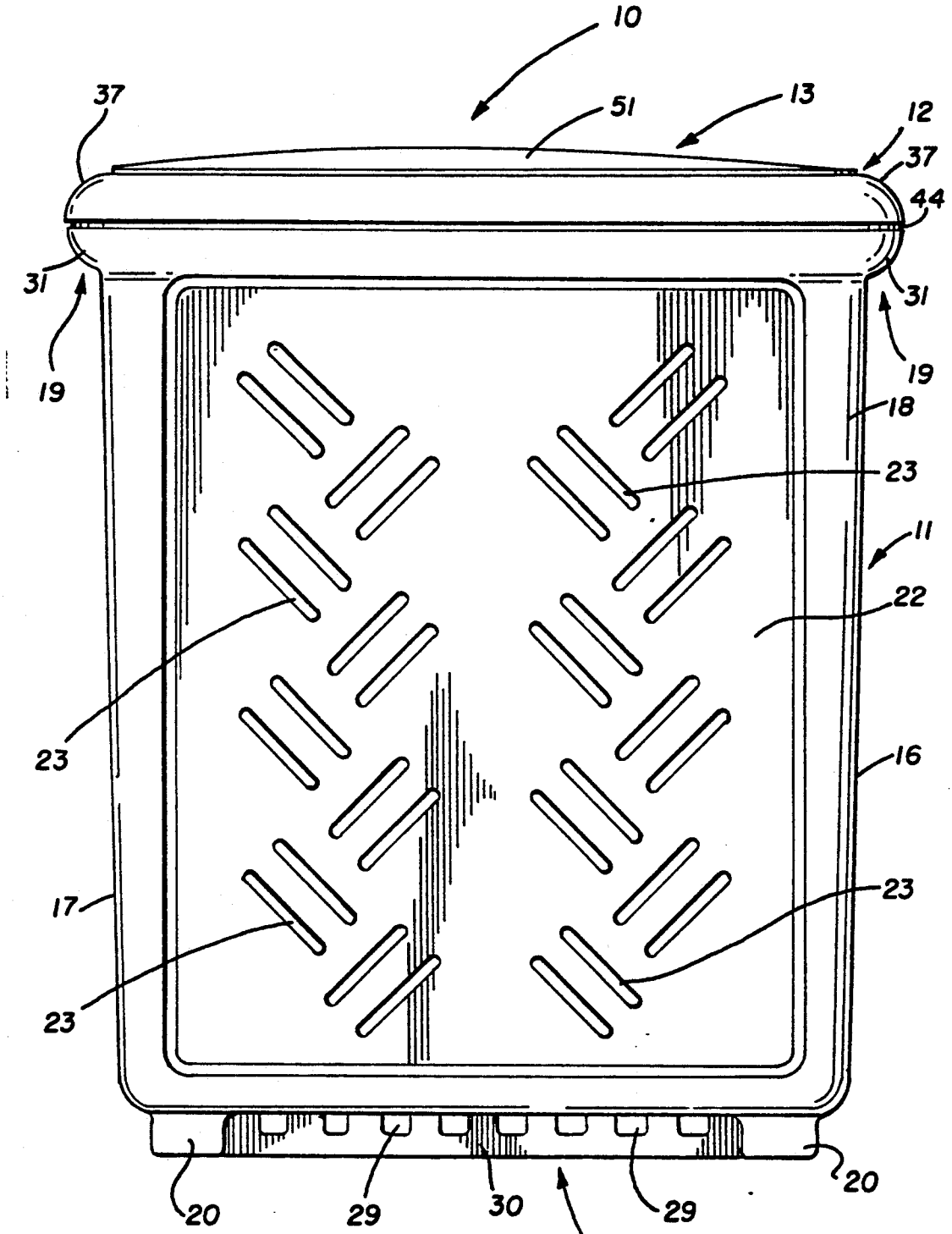
FIG. 3 is a rear elevational view of the hamper of FIG. 1.
Figure 4:
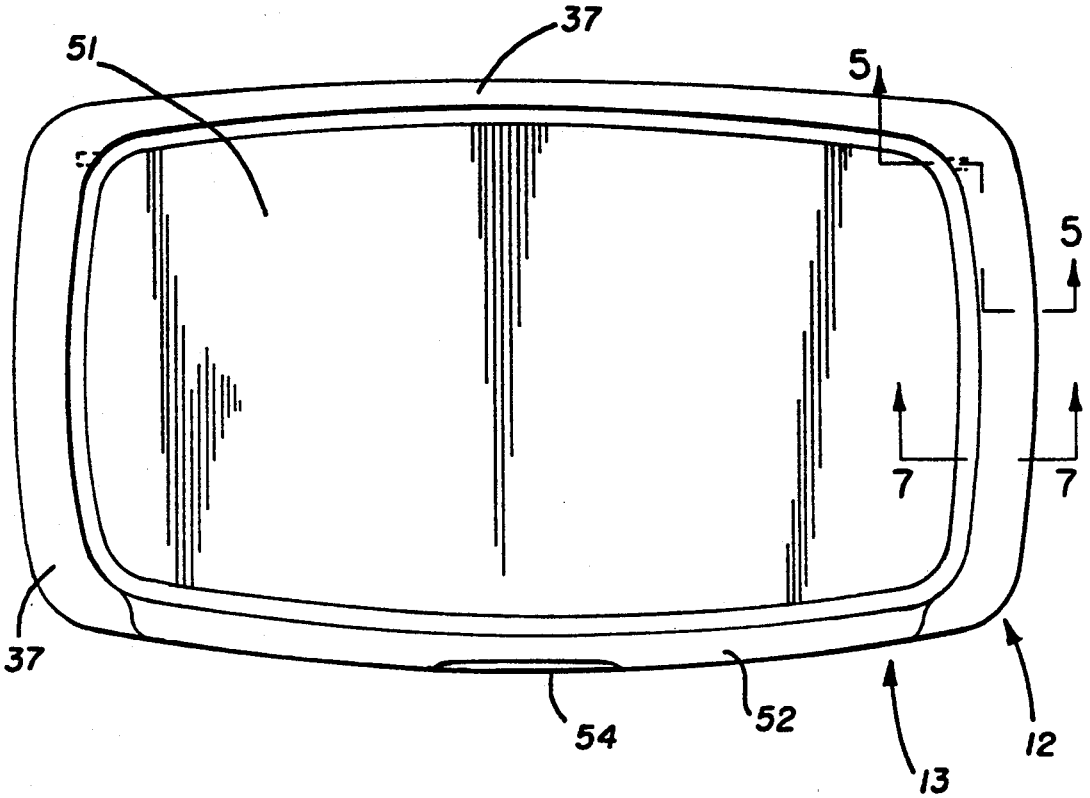
FIG. 4 is a top plan view of the hamper of FIG. 1.

However, apertures 23 alone may not be sufficient to provide hamper 10 with satisfactory ventilation. Thus, in order to provide some cross-ventilation, base container 11 is provided with a recessed ventilation system generally indicated by the numeral 24 and best shown in FIGS. 2 and 6. As shown, at the bottom thereof, front wall 15 turns inwardly, as at 25, and then turns back downwardly to provide a recessed arcuate wall 26 extending toward bottom surface 14. A plurality of vent apertures 27 are formed in arcuate wall 26 to provide the desired cross-ventilation. However, because these apertures are recessed behind front wall 15, they are not normally visually discernable to the user. Moreover, if desired, an identical rear wall recessed ventilation system, generally indicated by the numeral 28 in FIG. 3, may be provided. Like front ventilation system 24, rear ventilation system 28 would also include vent apertures 29 located in a recessed arcuate wall 30.

Figure 5:
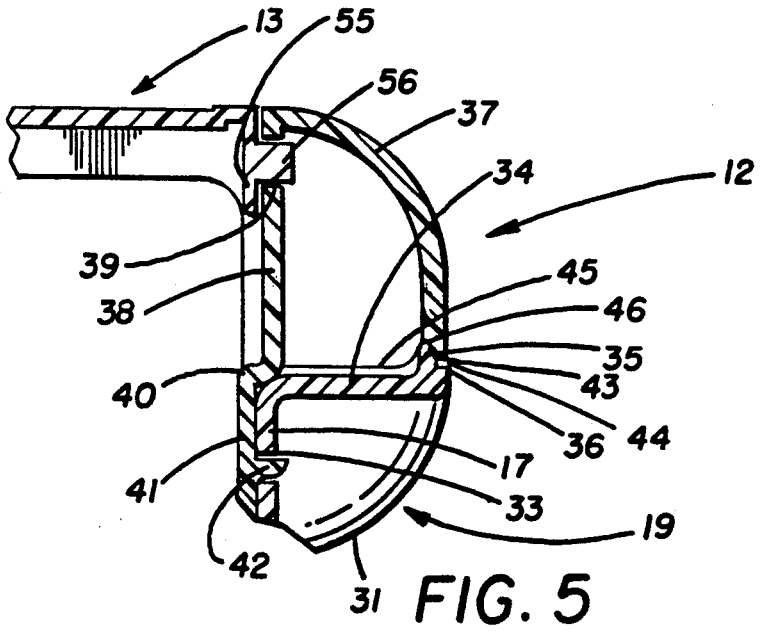
FIG. 5 is an enlarged sectional view taken substantially along line 5—5 of FIG. 4.

Upper shoulder rim 19 of base container 11 is best shown in FIGS. 1 and 5 as including an outer arcuate skirt 31 which is interrupted, as at 32, to form a handle portion near the top of side walls 16 and 17. At the area of the handles, side walls 16 and 17 are each provided with a slot 33 which, as will hereinafter be described, cooperates to attach shroud 12 to base container portion 11. As shown in FIG. 5, the top of side walls 16 and 17 are connected to the outermost top portion of arcuate skirt 31 by a horizontal ledge or shelf 34. A peripheral locator rim 35 extends upwardly from shelf 34 and is slightly inset along horizontal surface 36 from the outer periphery of skirt 31 to assist in the proper positioning of shroud 12, now to be described.

Shroud 12 is provided to render stability to base container portion 11 and rigidity to its open top so as to particularly prevent the parallelogram type of flexing which might occur if base container 11 were exposed to certain stresses. As shown in FIG. 5, shroud 12 includes a peripheral outer arcuate skirt 37 which is complementary to skirt 31 of rim 19 of base portion 11 to the extent that together skirts 37 and 31 provide an aesthetically pleasing composite arcuate upper surface for hamper 10.

A generally vertically oriented inner surface or wall 38 extends downwardly from the top of arcuate skirt 37 and is provided with an aperture 39 to receive cover 13 as will hereinafter be described. The bottom of surface 38 turns outwardly, and then downwardly again, as at 40, to form another generally vertically oriented inner locking surface or wall 41 extending downwardly within and generally parallel to the top of side walls 16 and 17. Lock tabs 42 extend outwardly from locking surface 41 and, when shroud 12 is assembled on base container portion 11, tabs 42 extend through side wall slots 33.

Figure 7:
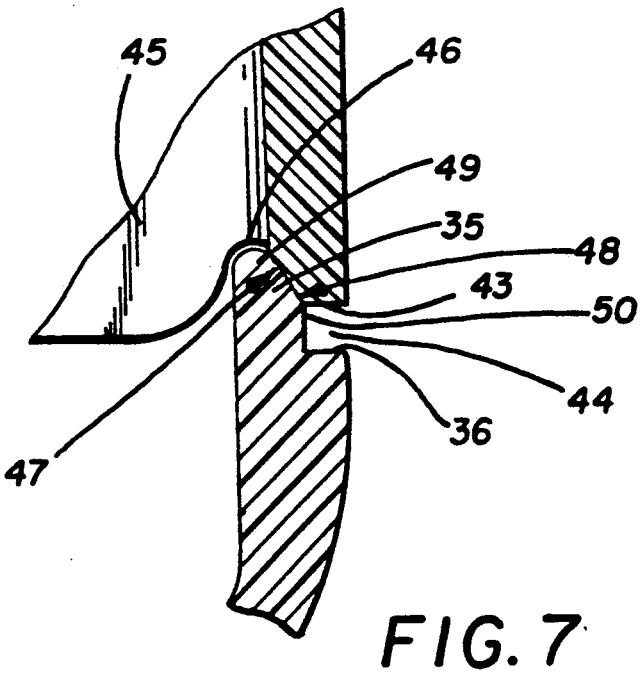
FIG. 7 is an enlarged sectional view taken substantially along line 7—7 of FIG. 4.

A horizontal ledge 43 is formed at the bottom of arcuate skirt 37 and is adapted to be spaced from surface 36 of rim 19 of base portion 11 when shroud 12 is assembled thereto to form a peripheral slot 44 between shroud 12 and rim 19. An internal peripheral rib 45 extends between the bottom of skirt 37 and locking surface 41 and is provided with a peripheral locating notch 46 adjacent to skirt 37 as best shown in FIG. 7. A bevelled surface 47 extends angularly from notch 46 to ledge 43. Bevelled surface 47 is adapted to engage a similarly bevelled surface 48 formed on locator rim 35 of rim 19 of base container 11. Bevelled surface 48 extends between a lug portion 49 of locator rim 35 and a vertical portion 50 which extends downwardly to horizontal surface 36 and is part of slot 44.

To attach shroud 12 to base container portion 11, locking surface 41 is slid along the inside of side walls 16 and 17, and while so moving it will flex inwardly until lock tabs 42 snap into slots 33 in side walls 16 and 17. At the same time bevelled surfaces 47 and 48 will engage each other as locator rim 35 becomes seated in notch 46. This arrangement, that is, the complementary bevelled surfaces 47 and 48, allows for facile and secure attachment between shroud 12 and base portion 11 accounting for manufacturing tolerances. Depending on the minute manufacturing dimensional variations which might be encountered, bevelled surface 47 may slide along bevelled surface 48 a differing amount from one hamper 10 to another hamper 10 thereby creating a slot 44 of slightly varying size from hamper to hamper.

Cover 13 is shown as having a slightly domed top surface 51 (FIGS. 2 and 3) terminating at its front end as a downturned front lip 52 which is adapted to rest on a complementary front recess 53 formed in the otherwise peripheral arcuate skirt 37 of shroud 12. Front lip 52, however, complements arcuate skirt 37 such that when cover 13 is closed, lip 52 effectively provides a continuation of the outer profile of skirt 37. Lip 52 is provided with a notch which forms a cover handle 54 generally centrally thereof for ease in lifting cover 13.

As best shown in FIG. 5, a flange 55 extends downwardly from each side of the rear of top surface 51 of cover 13. Flanges 55 (one shown) carry pivot pins 56 which may be snapped into apertures 39 formed in surface 38 of shroud 12. As such, cover 13 is pivotally or hingedly connected to shroud 12 which, as previously described, is connected to base container portion 11 to form, when assembled, one unit from three originally separate components.

It should thus be appreciated that a hamper constructed according to the concepts of the present invention as described herein accomplishes the objects of the invention and otherwise substantially improves the art.

We claim:

1. A hamper comprising a bottom surface; a front wall, a rear wall, and opposed side walls extending upwardly from said bottom surface to form an open top defined by an upper rim having an outer arcuate skirt; handle means formed near the top of said side walls by interruptions in said arcuate skirt; shroud means resting on said upper rim to provide rigidity to said upper rim; and means to attach said shroud means to said side walls.

2. A hamper according to claim 1 wherein said means to attach includes apertures in said side walls, and lock tabs carried by said shroud means and received in said apertures.

3. A hamper according to claim 1 further comprising means to locate said shroud means on said upper rim.

4. A hamper according to claim 3 wherein said means to locate includes a notch formed in said shroud means, and a locator rim extending upwardly from said rim and received in said notch.

5. A hamper according to claim 4 further comprising means to guide said locator rim into said notch.

6. A hamper according to claim 5 wherein said means to guide includes a bevelled surface formed in said shroud means below said notch and a complementary bevelled surface formed in said locator rim.

7. A hamper according to claim 1 further comprising an arcuate front wall recessed below said front wall, said arcuate front wall extending from said front wall to said bottom wall, and vent apertures in said arcuate front wall.

8. A hamper according to claim 7 further comprising an arcuate rear wall recessed below said rear wall, said arcuate rear wall extending from said rear wall to said bottom wall, and vent apertures in said arcuate rear wall.

9. A hamper comprising a base container portion, said base container portion including a bottom surface and walls extending upwardly therefrom to form an open top, shroud means attached to said base container portion to strengthen said open top formed by said walls, cover means pivotally connected to said shroud means to close said open top, a recessed arcuate surface formed beneath at least one of said walls and extending between said one of said walls and said bottom surface, and vent apertures in said recessed arcuate surface.

10. A hamper according to claim 9 further comprising pin means carried by said cover means and apertures formed in said shroud means to receive said pin means so that said cover means is pivotable with respect to said shroud means.

11. A hamper comprising a bottom surface; a front wall, a rear wall, and opposed side walls extending upwardly from said bottom surface to form an open top defined by an upper rim; shroud means resting on said upper rim to provide rigidity to said upper rim; means to attach said shroud means to said side walls; and a cover for closing said open top, said cover having a downturned front lip resting on said shroud means, and handle means formed by an interruption in said lip.

12. A hamper according to claim 11 wherein said upper rim includes an outer arcuate skirt.

13. A hamper according to claim 1 wherein said shroud means includes an outer arcuate skirt complementary to said arcuate skirt of said upper rim.

14. A hamper comprising a bottom surface; a front wall, a rear wall, and opposed side walls extending upwardly from said bottom surface to form an open top; an upper rim formed at the top of said walls around said open top; shroud means resting on said upper rim; cover means to close said open top pivotally connected to said shroud means; a recessed arcuate surface formed between at least one of said walls and said bottom surface; and vent apertures in said recessed arcuate surface.

15. A hamper according to claim 14 wherein a said arcuate surface is formed between said front wall and said bottom surface and another said arcuate surface is formed between said rear wall and said bottom surface, both said arcuate surfaces having vent apertures therein.

16. A hamper according to claim 15 further comprising additional vent apertures in said rear wall.

17. A hamper according to claim 14 further comprising means to attach said shroud means to said side walls.

18. A hamper according to claim 14 further comprising means to locate said shroud means on said upper rim.

* * * * *

UNITED STATES PATENT AND TRADEMARK OFFICE

CERTIFICATE OF CORRECTION

PATENT NO. : 5,242,074

DATED : September 7, 1993

INVENTOR(S) : Brian J. Conaway and Tyrone M. Keyes

It is certified that error appears in the above-identified patent and that said Letters Patent is hereby corrected as shown below:

Title page, [56], please add the following under U.S. Patent Documents and Other Publications:

| | | | |
|---|---|---|---|
| --D147,724 | 10/1947 | Gleitsman | D58/4 |
| D218,700 | 9/1970 | Levin | D49/8.2 |
| D265,261 | 6/1982 | Gerber | D32/37 |
| D274,662 | 7/1984 | Fausel | D32/37 |
| D312,519 | 11/1990 | Hobson | D32/37 |

OTHER PUBLICATIONS

Curver, Takkebijsters 75, P.O. Box 6810, 4802 Av., Breda, Holland, 1 page advertising sheet, date unknown.
Burlington Basket Company, Burlington, Iowa 52601, 6 catalog sheets, date unknown.
LaMont, P.O. Box 399, Burlington, IA 52601, 10 page catalog, date unknown.
Redmon, 8 page catalog, date unknown.
Zenith, "Tahiti Ensemble", 1 advertising sheet, date unknown.--

Signed and Sealed this

Twenty-third Day of August, 1994

*Attest:*

Bruce Lehman

BRUCE LEHMAN

*Attesting Officer*

*Commissioner of Patents and Trademarks*